US009059525B2

(12) United States Patent
Tai et al.

(10) Patent No.: US 9,059,525 B2
(45) Date of Patent: Jun. 16, 2015

(54) PIN STRUCTURE OF RJ CONNECTOR, RJ CONNECTOR MODULE AND RJ CONNECTOR SYSTEM USING THE SAME

(71) Applicant: DELTA ELECTRONICS, INC., Kuei San, Taoyuan Hsien (TW)

(72) Inventors: Chin-Chung Tai, Taoyuan Hsien (TW); Hua-Sheng Shih, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 64 days.

(21) Appl. No.: 13/799,369

(22) Filed: Mar. 13, 2013

(65) Prior Publication Data

US 2014/0080360 A1 Mar. 20, 2014

(30) Foreign Application Priority Data

Sep. 17, 2012 (TW) ..... 101134013 A

(51) Int. Cl.

| | |
|---|---|
| ***H01R 24/00*** | (2011.01) |
| ***H01R 13/405*** | (2006.01) |
| ***H01R 13/6474*** | (2011.01) |
| ***H01R 24/64*** | (2011.01) |

(52) U.S. Cl.

CPC ..... *H01R 13/405* (2013.01); *H01R 13/6474* (2013.01); *H01R 24/64* (2013.01)

(58) Field of Classification Search

CPC ..... H01R 23/005; H01R 23/025
USPC ..... 439/676, 941
See application file for complete search history.

(56) References Cited

U.S. PATENT DOCUMENTS

| | | | | |
|---|---|---|---|---|
| 6,932,655 | B2 * | 8/2005 | Hatterscheid et al. | 439/676 |
| 8,002,590 | B2 * | 8/2011 | Ciezak et al. | 439/676 |
| 8,039,482 | B2 * | 10/2011 | Sugihara et al. | 514/305 |

* cited by examiner

*Primary Examiner* — Phuong Dinh
(74) *Attorney, Agent, or Firm* — Muncy, Geissler, Olds & Lowe, P.C.

(57) ABSTRACT

A pin structure of an RJ connector includes a base and eight pins. The eight pins includes a first pin, a second pin, a third pin, a fourth pin, a fifth pin, a sixth pin, a seventh pin and an eighth pin. One end of each pin has a contact part, and the contact parts are aligned in sequence. The other end of each pin is bent to form an inserting part, and the inserting parts are embedded in the base. The distance between the inserting parts of the third and sixth pins is smaller than the distance between the contact parts thereof. An RJ connector module and an RJ connector system with the pin structure are also disclosed. The pin structure is advantageous for decreasing cross-talk and insertion loss generated in the RJ connector, and further increasing the signal definition and accuracy.

18 Claims, 8 Drawing Sheets

PIN STRUCTURE OF RJ CONNECTOR, RJ CONNECTOR MODULE AND RJ CONNECTOR SYSTEM USING THE SAME

CROSS REFERENCE TO RELATED APPLICATIONS

This Non-provisional application claims priority under 35 U.S.C. §119(a) on Patent Application No(s). 101134013 filed in Taiwan, Republic of China on Sep. 17, 2012, the entire contents of which are hereby incorporated by reference.

BACKGROUND OF THE INVENTION

1. Field of Invention

The present invention relates to an RJ connector and, in particular, to a pin structure of an RJ connector.

2. Related Art

As the progressive of technology, the electronic apparatuses used in the electronic-information industry are developed to be minimized and with multiple functions. In order to facilitate the information transmission between different electronic apparatuses, many communication protocols are developed and the corresponding connectors for transmitting information between the electronic apparatuses are also provided. For example, the twisted pair connector is mainly applied to network interface. The twisted pair connector includes an RJ45 connector and an RJ11 connector.

Recently, the electronic apparatuses are usually equipped with multiple functions, and the signal transmission amount is sufficiently increased. At the same time, the components of the electronic apparatuses such as computers become lighter and smaller. To satisfy both of the above requirements, the RJ connector with more pins and smaller size, which is applied to high-frequency transmission, is disclosed.

However, the pins of the RJ connector are arranged in parallel inside an insulation base, so the adjacent pins may generate capacitive coupling as transmitting high-speed or high-frequency signals. The high capacitive coupling can easily cause the cross-talk between the adjacent pins, so that the transmitted signals are deformed and weakened. This undesired cross-talk will affect the accuracy of the transmitted signals and the operation of the electronic apparatus. Regarding to the issue of cross-talk, a filter device is configured in the connector to inhibit the noises generated by the undesired cross-talk. However, this method will increase the cost of the connector and is not suitable for the minimization.

In addition, the signal transmission route between the pins of the transmission system may easily have the problem of impedance matching, which will cause the insertion loss during the signal transmission, so that the intensity of the output signal will be decreased.

Therefore, it is an important subject to provide a pin structure of an RJ connector, which has simple design and configuration for preventing cross-talk and insertion loss during the high-frequency signal transmission, thereby improving the signal quality and increasing the transmission performance.

SUMMARY OF THE INVENTION

In view of the foregoing subject, an objective of the present invention is to provide a pin structure of an RJ connector, which has simple design and configuration for preventing cross-talk and insertion loss during the high-frequency signal transmission, thereby improving the signal quality and increasing the transmission performance.

To achieve the above objective, the present invention discloses a pin structure of an RJ connector, which includes a base and eight pins. The eight pins comprises a first pin, a second pin, a third pin, a fourth pin, a fifth pin, a sixth pin, a seventh pin and an eighth pin. One end of each pin has a contact part, and the other end of each pin is bent to form an inserting part. The contact parts are aligned in sequence, and the inserting parts are embedded in the base. A distance between the inserting parts of the third pin and the sixth pin is smaller than a distance between the contact parts of the third pin and the sixth pin.

In one embodiment, the base is an insulation element.

In one embodiment, the lengths and types of the first pin and the second pin are substantially the same.

In one embodiment, a distance between the inserting parts of the first pin and the second pin is equal to a distance between the contact parts of the first pin and the second pin.

In one embodiment, the lengths and types of the fourth pin and the fifth pin are substantially the same.

In one embodiment, a distance between the inserting parts of the fourth pin and the fifth pin is equal to a distance between the contact parts of the fourth pin and the fifth pin.

In one embodiment, the lengths and types of the seventh pin and the eighth pin are substantially the same.

In one embodiment, a distance between the inserting parts of the seventh pin and the eighth pin is equal to a distance between the contact parts of the seventh pin and the eighth pin.

In one embodiment, the types of the third pin and the sixth pin are different.

In one embodiment, the lengths of the third pin and the sixth pin are substantially the same.

In one embodiment, the inserting parts of the third pin and the sixth pin are disposed adjacent to each other.

In one embodiment, the inserting parts of the first pin, the second pin, the fourth pin, the fifth pin, the seventh pin and the eighth pin are located at a second height, the inserting parts of the third pin and the sixth pin are located at a first height, and the first height is different from the second height.

To achieve the above objective, the present invention also discloses a pin structure of an RJ connector, which includes a first pin assembly and a second pin assembly. The first pin assembly is disposed on a first base, while the second pin assembly is disposed on a second base. The first pin assembly comprises a first pin, a second pin, a fourth pin, a fifth pin, a seventh pin and an eighth pin. The second pin assembly comprises a third pin and a sixth pin. One end of each pin has a contact part, and the other end of each pin is bent to form an inserting part. The contact parts are aligned in sequence, and the inserting parts are embedded in the first base and the second base, respectively. A distance between the inserting parts of the third pin and the sixth pin is smaller than a distance between the contact parts of the third pin and the sixth pin.

To achieve the above objective, the present invention also discloses an RJ connector module, which includes a filter and at least a pin structure electrically connected with the filter. The pin structure comprises a base and eight pins comprising a first pin, a second pin, a third pin, a fourth pin, a fifth pin, a sixth pin, a seventh pin and an eighth pin. One end of each pin has a contact part, and the other end of each pin is bent to form an inserting part. The contact parts are aligned in sequence, and the inserting parts are embedded in the base. A distance between the inserting parts of the third pin and the sixth pin is smaller than a distance between the contact parts of the third pin and the sixth pin.

To achieve the above objective, the present invention also discloses an RJ connector system, which includes an RJ connector module and a main circuit board electrically connected with the pins. The RJ connector module comprises a filter and at least a pin structure electrically connected with the filter. The pin structure comprises a base and eight pins comprising a first pin, a second pin, a third pin, a fourth pin, a fifth pin, a sixth pin, a seventh pin and an eighth pin. One end of each pin has a contact part, and the other end of each pin is bent to form an inserting part. The contact parts are aligned in sequence, and the inserting parts are embedded in the base. A distance between the inserting parts of the third pin and the sixth pin is smaller than a distance between the contact parts of the third pin and the sixth pin.

As mentioned above, the pin structure of an RJ connector of the invention has unique pin shape, configuration and distribution, so it can efficiently improve the signal transmission of the current RJ connector. In more detailed, the distance between the inserting parts of the third and sixth pins of the pin structure is smaller than the distance between the contact parts thereof. This configuration can achieve a better impedance matching between two pins and decrease the insertion loss and return loss during signal transmission.

Regarding to the configuration and distribution of the pin structure, the inserting parts of the third and sixth pins are located at a vertical height different from the residual pins. Based on this design, the capacitive coupling during the high-frequency transmission can be decreased, so that the cross-talk can be further reduced. Compared with the conventional art, the present invention does not need any additional filter or needs only a lower performance filter, but can easily achieve the signal intensity and definition even with or better than the conventional RJ connector module.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
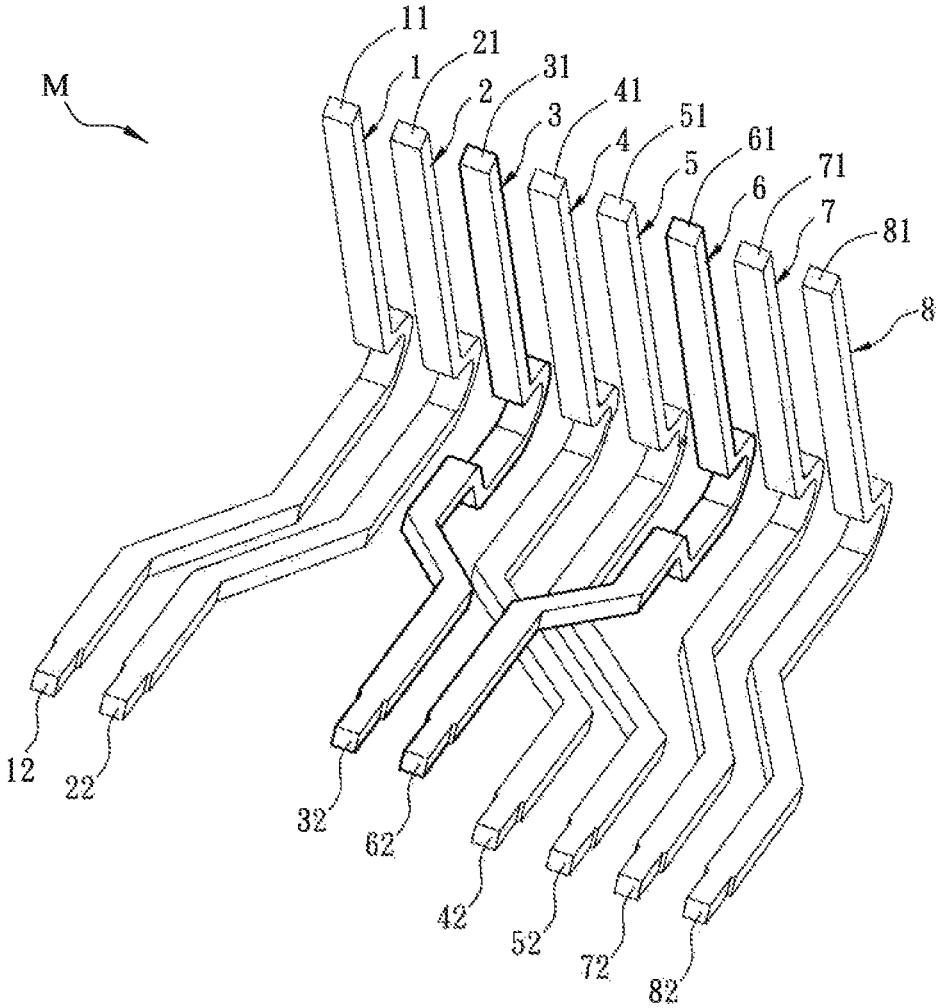
FIG. 1A is a schematic diagram of a pin structure of an RJ connector according to an embodiment of the present invention.
Figure 1B:
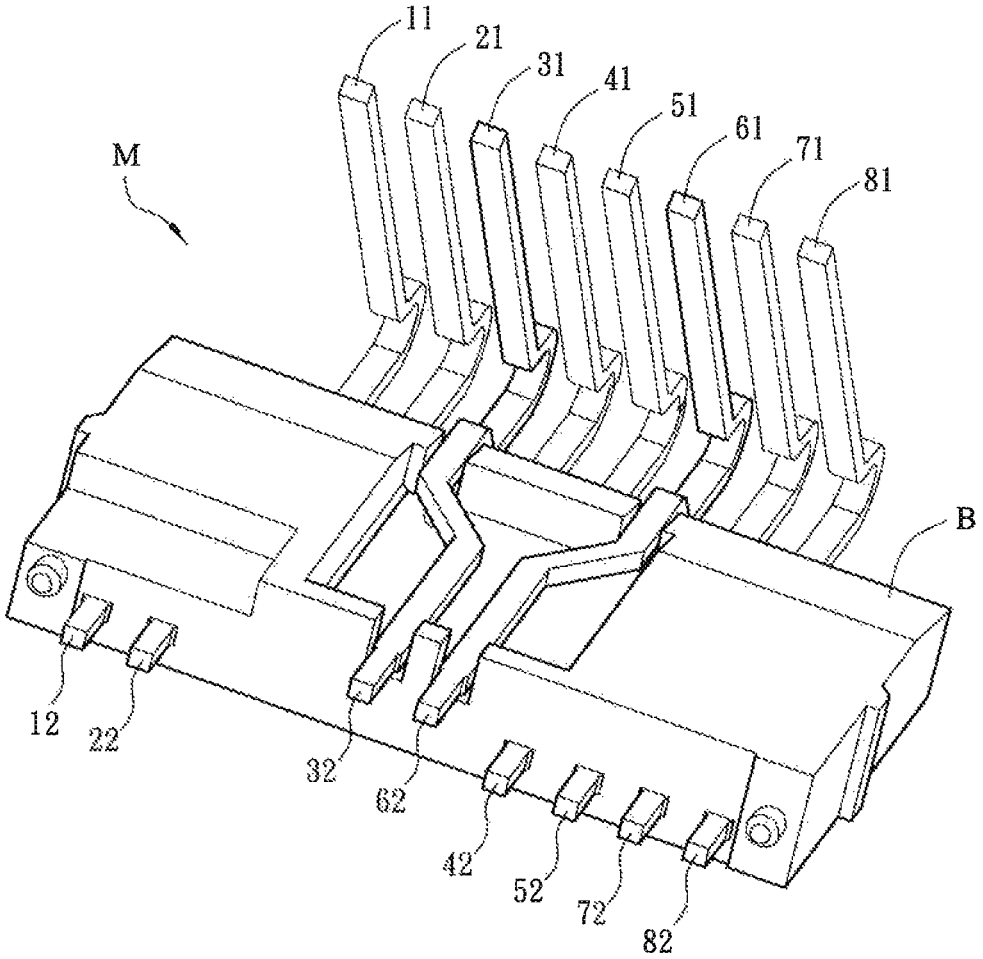
FIG. 1B is a schematic diagram of an RJ connector according to the embodiment of the present invention.

FIG. 1A is a schematic diagram of a pin structure of an RJ connector according to an embodiment of the present invention, and FIG. 1B is a schematic diagram of an RJ connector according to the embodiment of the present invention. Referring to FIGS. 1A and 1B, a pin structure M includes a base B and eight pins including a first pin 1, a second pin 2, a third pin 3, a fourth pin 4, a fifth pin 5, a sixth pin 6, a seventh pin 7, and an eighth pin 8. In this embodiment, the pin structure M of an RJ connector is applied to a network connector. In practice, the pin structure M is installed within a modular jack. This configuration is not a limitation, and it can be applied to any other applicable connector.

With reference to FIGS. 1A and 1B, each pin of the pin structure M has one end configured with a contact part, such as contact parts 11, 21, 31, 41, 51, 61, 71 and 81, and the contact parts are arranged in sequence. In addition, the other end of each pin opposite to the contact part is bent to form an inserting part, such as inserting parts 12, 22, 32, 42, 52, 62, 72 and 82. The inserting parts 12, 22, 32, 42, 52, 62, 72 and 82 are embedded in the base B so as to install the pin structure M in the base B. In this embodiment, the base B is an insulation body, and is configured with eight position holes at different vertical heights. The inserting parts 12, 22, 32, 42, 52, 62, 72 and 82 are embedded in the first to eighth pins 1, 2, 3, 4, 5, 6, 7 and 8.

Figure 2:
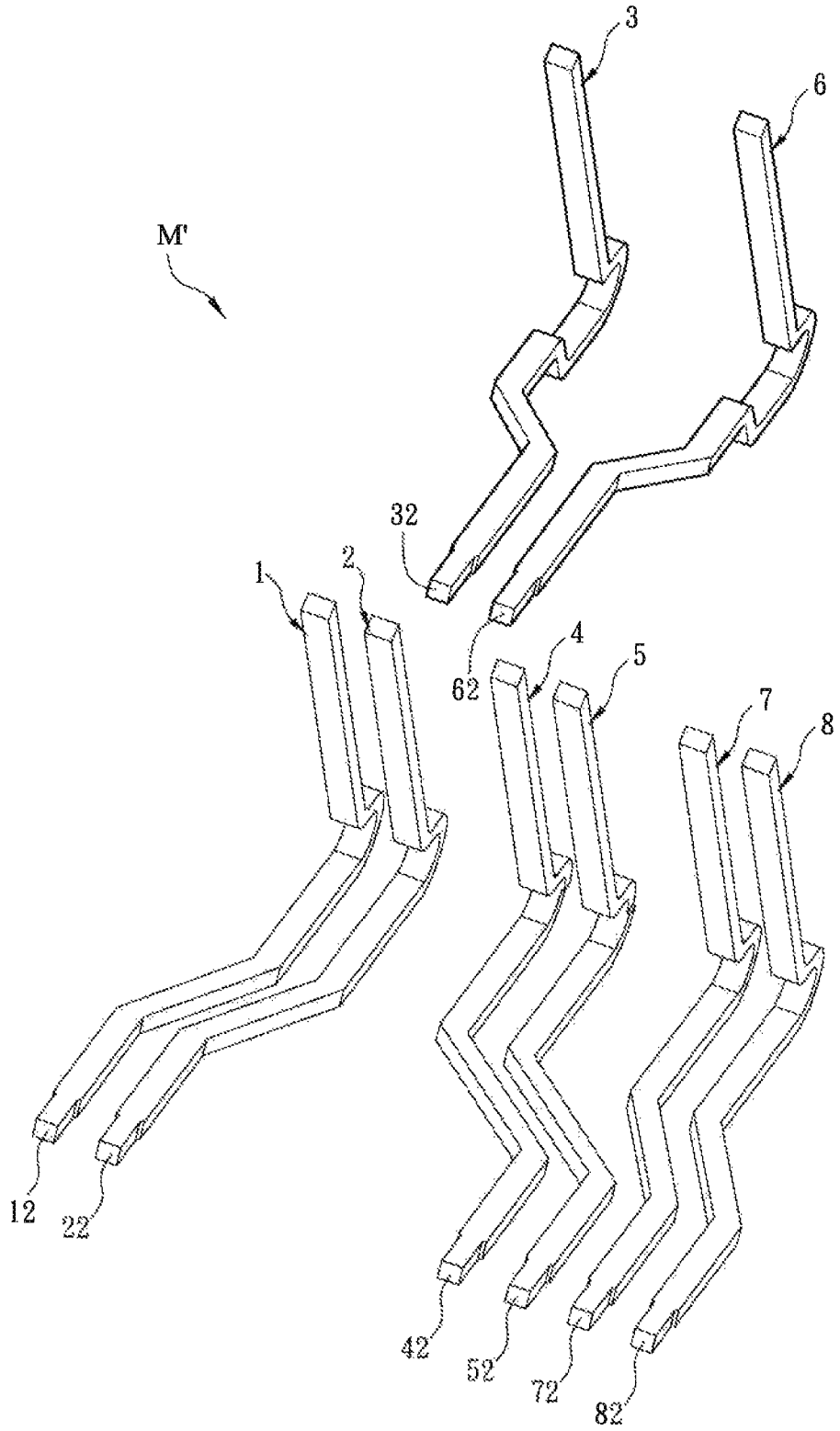
FIG. 2 is an exploded view of the pin structure of the RJ connector of FIG. 1A.

FIG. 2 is an exploded view of the pin structure of the RJ connector of FIG. 1A. Referring to FIG. 2, a part of the pin structure M is shown for emphasizing the types and relative positions of the inserting parts 12, 22, 32, 42, 52, 62, 72 and 82.

To be noted, the pins are divided into several groups, and each group includes two pins forming a signal pair, such as the first and second pins 1 and 2, the fourth and fifth pins 4 and 5, the seventh and eighth pins 7 and 8, and the third and sixth pins 3 and 6. Except for the third and sixth pins 3 and 6, the contact parts of the other three signal pairs are extended outwardly for increasing the range and intervals of the entire inserting parts. According to this configuration, the RJ connector of the present invention can decrease the generation of noise during signal transmission. In other words, The RJ connector of the present invention can decrease the cross-talk between the signal pairs. Preferably, the layout of the pins on the circuit board becomes simpler as the distances between the inserting parts of the signal pairs are increased.

In this embodiment, the distance between the inserting parts 32 and 62 of the third pin 3 and the sixth pin 6 is small than that between the contact parts 31 and 61 of the third pin 3 and the sixth pin 6. In other words, the inserting parts 31 and 61 of the third pin 3 and the sixth pin 6 approaches to each other and is close to their center. According to this configuration of the third pin 3 and the sixth pin 6, the impedance of the contact parts is different from the impedance of the inserting parts, so that the impedance matching between two pins is improved to decrease the insertion loss and return loss during the signal transmission.

Besides, the distance between the inserting parts 12 and 22 of the first pin 1 and the second pin 2 is equal to the distance between the contact parts 11 and 21 of the first pin 1 and the second pin 2; the distance between the inserting parts 42 and 52 of the fourth pin 4 and the fifth pin 5 is equal to the distance between the contact parts 41 and 51 of the fourth pin 4 and the fifth pin 5; the distance between the inserting parts 72 and 82 of the seventh pin 7 and the eighth pin 8 is equal to the distance between the contact parts 71 and 81 of the seventh pin 7 and the eighth pin 8. In more detailed, the first pin 1 is parallel to the second pin 2, the fourth pin 4 is parallel to the fifth pin 5, and the seventh pin 7 is parallel to the eighth pin 8. That is, the lengths, shapes and bending directions of each signal pair, such as the first pin 1 and the second pin 2, the fourth pin 4 and the fifth pin 5, or the seventh pin 7 and the eighth pin 8, are substantially the same. In addition, although the bending directions of the third pin 3 and the sixth pin 6 are different, they are substantially symmetric to each other and their lengths are substantially the same. To be noted, the term "substantially the same" is not to limit the conditions to be identically the same, but to cover any theoretically/practically allowable error caused by any manufacturing defect or special circumstance. The pins of a signal pair have substantially the same length, so that the lengths of the signals transmitted through the pins are similar. Thus, the signal delay of a signal pair can be sufficiently decreased, and preferably, the signal deformation and decay can be prevented.

In this embodiment, the inserting parts of the fourth pin 4 and the fifth pin 5 are bent toward the signal pair of the seventh pin 7 and the eighth pin 8. This configuration is not a limitation, and for example, the inserting parts of the fourth pin 4 and the fifth pin 5 can be bent toward the signal pair of the first pin 1 and the second pin 2. The configuration of the inserting parts of the fourth pin 4 and the fifth pin 5 should achieve the function of separating the third pin 3 and the sixth pin 6*y* for decreasing the undesired cross-talk.

Figure 3:
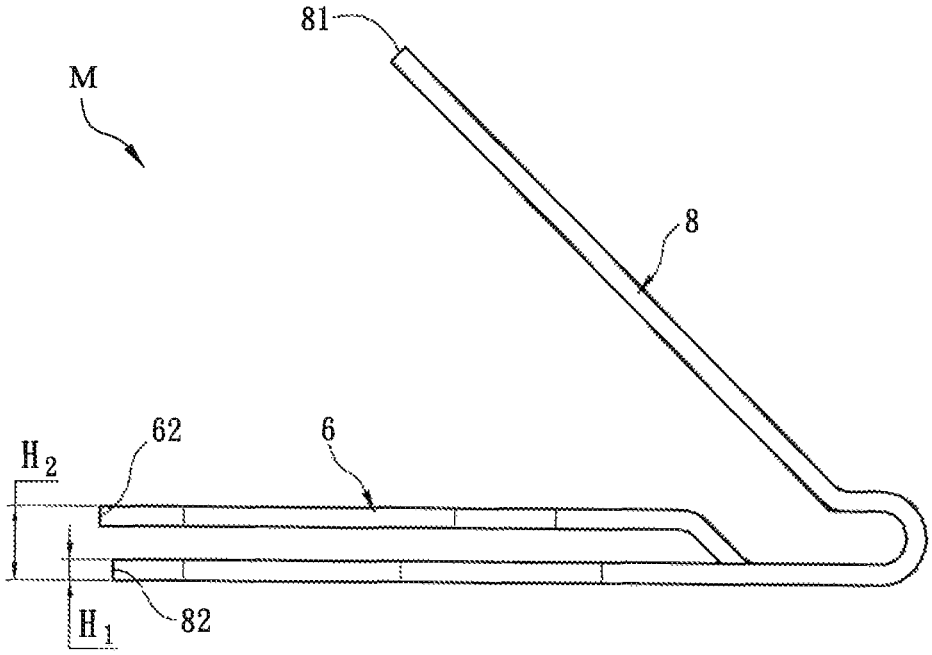
FIG. 3 is a side view of the pin structure of the RJ connector of FIG. 1A.

FIG. 3 is a side view of the pin structure of the RJ connector of FIG. 1A. Referring to FIGS. 1A and 3, from the side view, the inserting parts of the pins of the pin structure M are vertically arranged at a first height H1 and a second height H2, and the second height H2 is higher than the first height H1. FIG. 3 shows the eighth pin 8 and the sixth pin 6 for an illustration. In more detailed, the inserting parts 12, 22, 42, 52, 72 and 82 of the first pin 1, the second pin 2, the fourth pin 4, the fifth pin 5, the seventh pin 7 and the eighth pin 8 are located at the first height H1, while the inserting parts 32 and 62 of the third pin 3 and the sixth pin 6 are located at the second height H2. To be noted, the above example of the heights H1 and H2 is not limited, and any arrangement that configures the first height H1 and the second height H2 at different positions is acceptable. Since the inserting parts 32 and 62 of the third pin 3 and the sixth pin 6 are separated from the residual signal pairs, the cross-talk can be decreased so as to enhance the accuracy of the signals.

Figure 4:
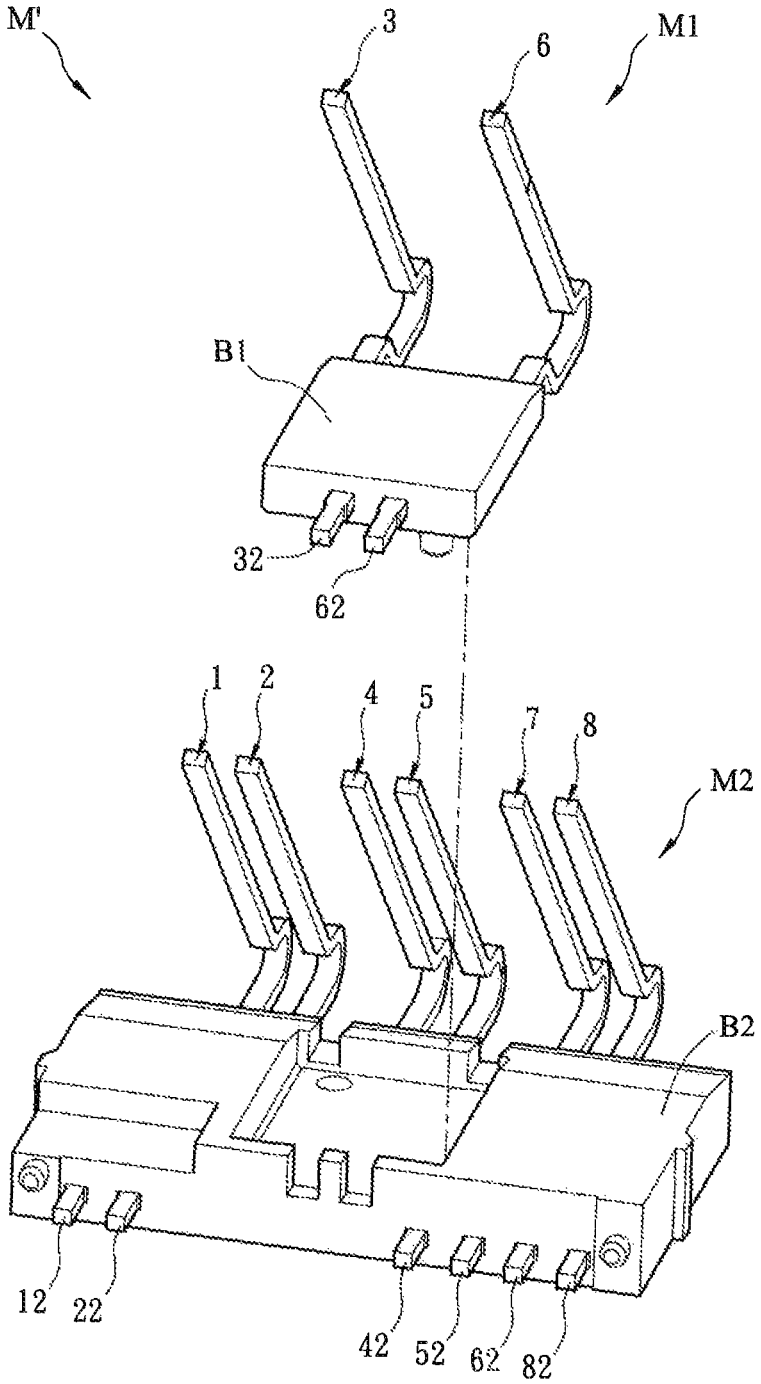
FIG. 4 is a schematic diagram of a pin structure of an RJ connector according to another embodiment of the present invention.

FIG. 4 is a schematic diagram of a pin structure of an RJ connector according to another embodiment of the present invention. In this embodiment, a pin structure M' of an RJ connector is almost the same as the previously mentioned pin structure M, but the eight pins are divided into a first pin assembly M1 and a second pin assembly M2. Herein, the first pin assembly M1 includes the third pin 3 and the sixth pin 6, and the second pin assembly M2 includes the residual six pins. The structures of the third pin 3 and the sixth pin 6 are different from the structures of the other six pins. For example, the distance between the inserting parts 32 and 62 of the third pin 3 and the sixth pin 6 is relatively smaller than the distances between the other pins. In practice, the third pin 3 and the sixth pin 6 are disposed at a first base B1, and the other six pins of the second pin assembly are disposed at a second base B2. After the first pin assembly M1 and the second pin assembly M2 are separately fabricated, they are further combined for the consequent application. This configuration is benefit to the injection molding process and can simplify the manufacturing procedure.

Figure 5:
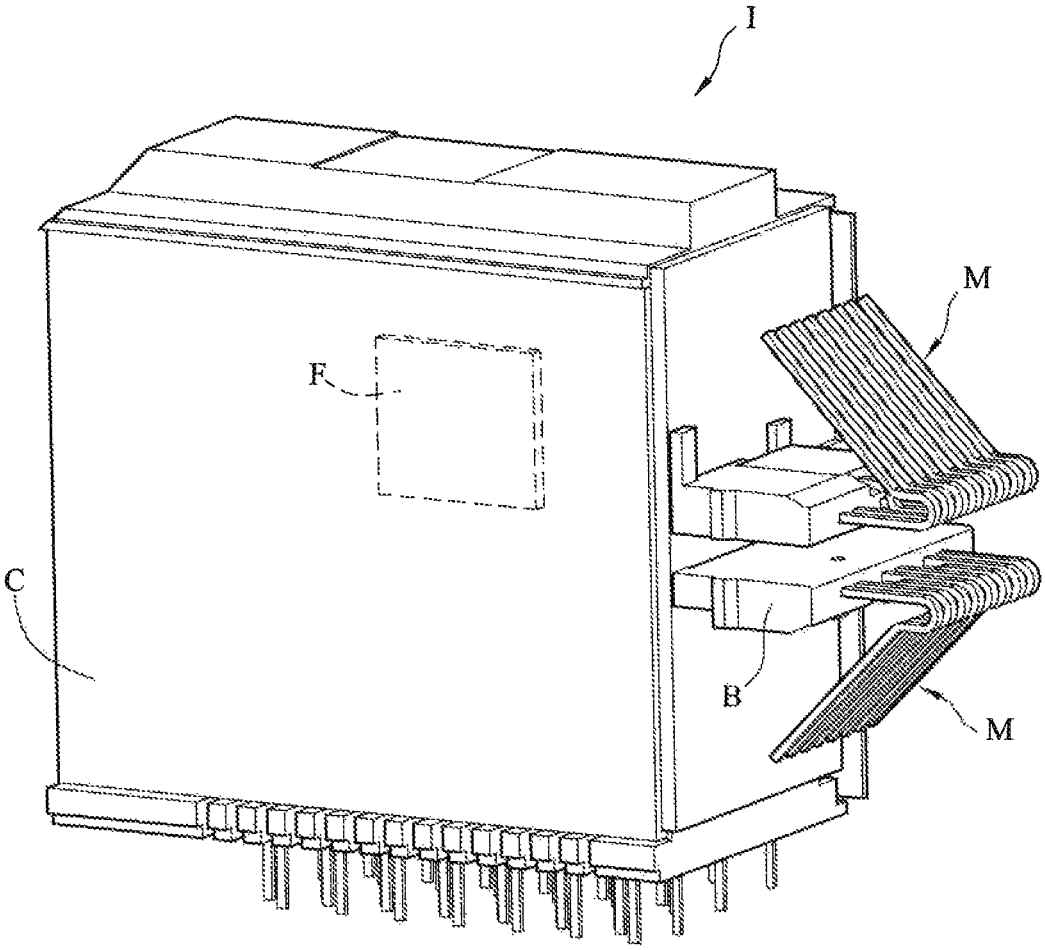
FIG. 5 is a schematic diagram of an RJ connector module according to the embodiment of the present invention.

FIG. 5 is a schematic diagram of an RJ connector module according to the embodiment of the present invention. With reference to FIG. 5, an RJ connector module I includes a filter F and at least one pin structure M. The pin structure M is electrically connected with the filter F. To be noted, this embodiment discloses a structure including two stacked pin structures M. The structure and feature of the pin structure M are the same as those of the above-mentioned pin structure M, so the detailed descriptions thereof will be omitted.

In this embodiment, the bases B of two pin structures M are respectively connected to a shielding case C. A filter F is configured in the shielding case C for filtering the signals transmitted from the pins. The connection between the pin structures M and the filter F is not limited. For example, they can be connected by wires or through a circuit board, and this invention is not limited. Since the pin structures of the present invention can reduce cross-talk, the filter with lower performance is useable. Thus, the present invention can easily achieve the signal intensity and definition even with or better than the conventional RJ connector module. In addition, the shielding case C can cover the filter F and the periphery circuit board (not shown) to, for example but not limited to, isolate the electromagnetic wave interference. When the RJ connector module I is applied to the circumstance that is non-sensitive to electromagnetic wave interference, the shielding case can be removed.

Figure 6A:
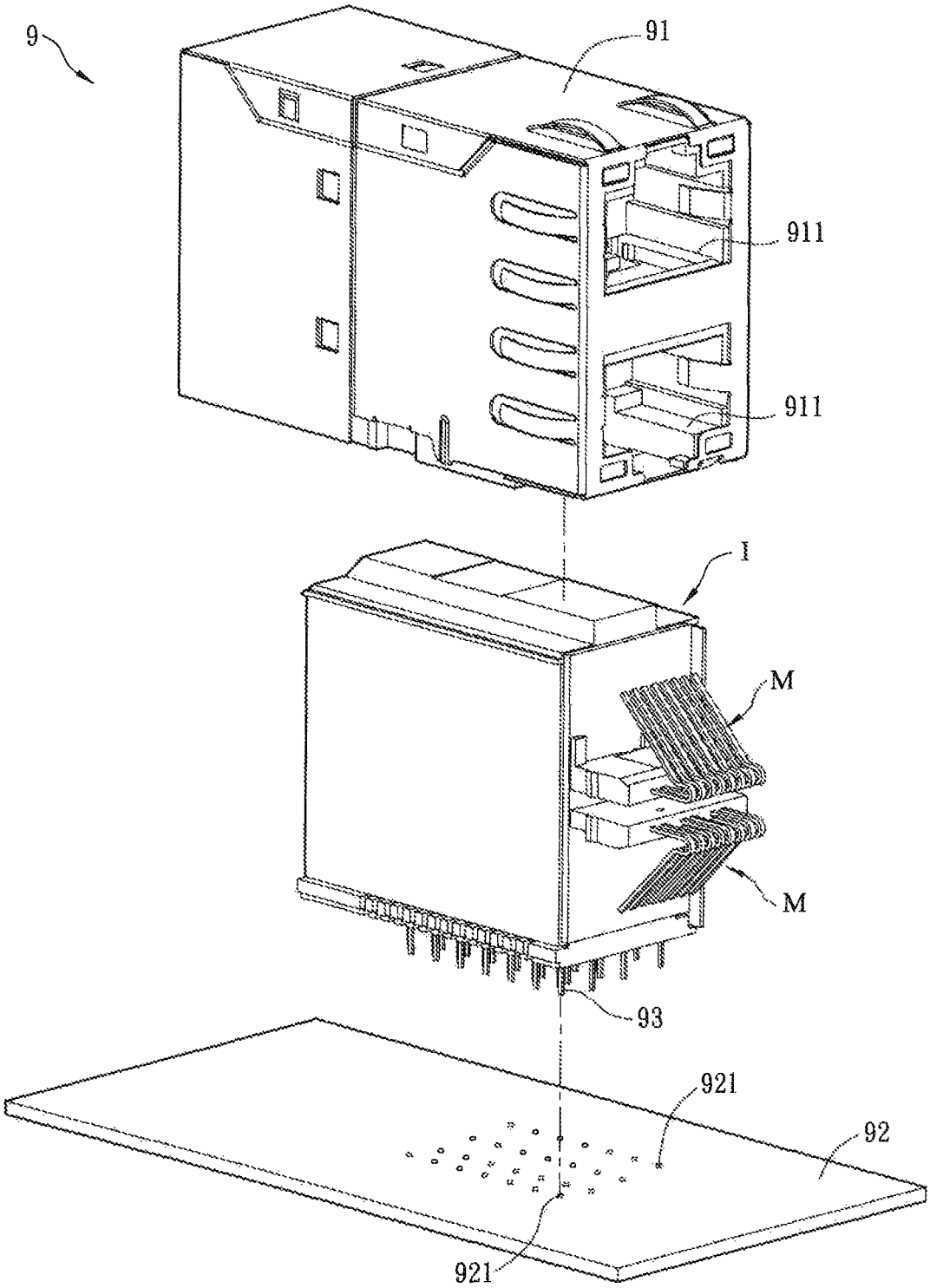
FIG. 6A is a schematic diagram of an RJ connector system according to the embodiment of the present invention.
Figure 6B:
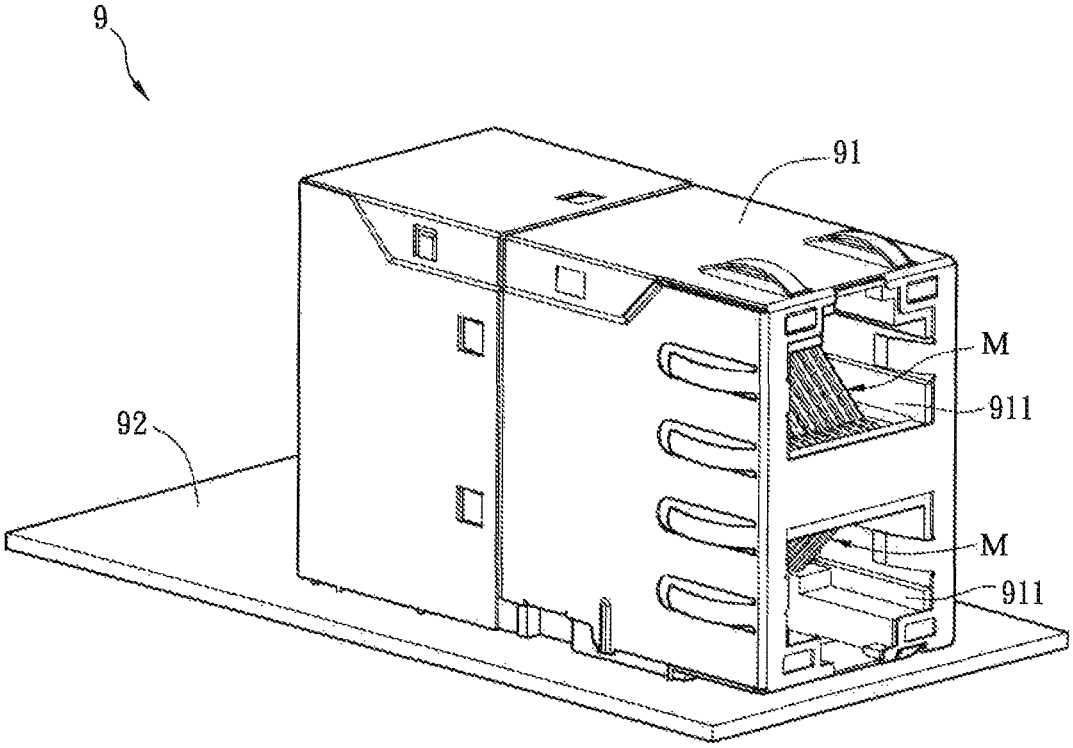
FIG. 6B is a schematic diagram showing the assembled RJ connector system of FIG. 6A.

FIG. 6A is a schematic diagram of an RJ connector system according to the embodiment of the present invention, and FIG. 6B is a schematic diagram showing the assembled RJ connector system of FIG. 6A. Referring to FIGS. 6A and 6B, an RJ connector system 9 includes an RJ connector module I and a main circuit board 92. The structure and feature of the RJ connector module I are the same as those of the previous embodiment, so the detailed descriptions thereof will be omitted. The RJ connector module I is configured in a port body 91 with two openings 911, and a plurality of conductors 93 are provided to connect with the corresponding vias 921 of the main circuit board 92 for electrically connecting the pin structure M to the main circuit board 92. The number of the openings 911 on the port body 91 is determined based on the number of the pin structures and the entire transmission requirement.

In summary, the pin structure of an RJ connector of the invention has unique pin shape, configuration and distribution, so it can efficiently improve the signal transmission of the current RJ connector. In more detailed, the distance between the inserting parts of the third and sixth pins of the pin structure is smaller than the distance between the contact parts thereof. This configuration can achieve a better impedance matching between two pins and decrease the insertion loss and return loss during signal transmission.

Regarding to the configuration and distribution of the pin structure, the inserting parts of the third and sixth pins are located at a vertical height different from the residual pins. Based on this design, the capacitive coupling during the high-frequency transmission can be decreased, so that the cross-talk can be further reduced. Compared with the conventional art, the present invention does not need any additional filter or needs only a lower performance filter, but can easily achieve the signal intensity and definition even with or better than the conventional RJ connector module.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A pin structure of an RJ connector, comprising:

a base; and eight pins comprising a first pin, a second pin, a third pin, a fourth pin, a fifth pin, a sixth pin, a seventh pin and an eighth pin, wherein one end of each pin has a contact part, the contact parts are aligned in sequence, the other end of each pin is bent to form an inserting part, and the inserting parts are embedded in the base;

wherein, a distance between the inserting parts of the third pin and the sixth pin is smaller than a distance between the contact parts of the third pin and the sixth pin, wherein the inserting parts of the first pin, the second pin, the fourth pin, the fifth pin, the seventh pin and the eighth pin are located at a second height the inserting parts of the third pin and the sixth pin are located at a first height, and the first height is different from the second height.

2. The pin structure of claim 1, wherein the base is an insulation element.

3. The pin structure of claim 1, wherein the lengths and types of the first pin and the second pin are substantially the same.

4. The pin structure of claim 1, wherein a distance between the inserting parts of the first pin and the second pin is equal to a distance between the contact parts of the first pin and the second pin.

5. The pin structure of claim 1, wherein the lengths and types of the fourth pin and the fifth pin are substantially the same.

6. The pin structure of claim 1, wherein a distance between the inserting parts of the fourth pin and the fifth pin is equal to a distance between the contact parts of the fourth pin and the fifth pin.

7. The pin structure of claim 1, wherein the lengths and types of the seventh pin and the eighth pin are substantially the same.

8. The pin structure of claim 1, wherein a distance between the inserting parts of the seventh pin and the eighth pin is equal to a distance between the contact parts of the seventh pin and the eighth pin.

9. The pin structure of claim 1 wherein the types of the third pin and the sixth pin are different.

10. The pin structure of claim 1, wherein the lengths of the third pin and the sixth pin are substantially the same.

11. The pin structure of claim 1, wherein the inserting parts of the third pin and the sixth pin are disposed adjacent to each other.

12. The pin structure of claim 1, wherein there are no other pins been disposed between the inserting parts of the third pin and the sixth pin.

13. A pin structure of an RJ connector, comprising:

a first pin assembly disposed on a first base, wherein the first pin assembly comprises a first pin, a second pin, a fourth pin, a fifth pin, a seventh pin and an eighth pin; and a second pin assembly disposed on a second base, wherein the second pin assembly comprises a third pin and a sixth pin;

wherein, one end of each pin has a contact part, the contact parts are aligned in sequence, the other end of each pin is bent to form an inserting part, the inserting parts are embedded in the first base and the second base, respectively, and a distance between the inserting parts of the third pin and the sixth pin is smaller than a distance between the contact parts of the third pin and the sixth pin, wherein the inserting parts of the first pin, the second pin, the fourth pin, the fifth pin, the seventh pin and the eighth pin are located at a second height, the inserting parts of the third pin and the sixth pin are located at a first height, and the first height is different from the second height.

14. The RJ connector of claim 13, wherein there are no other pins been disposed between the inserting parts of the third pin and the sixth pin.

15. An RJ connector module, comprising:

a filter, and at least a pin structure electrically connected with the filter, wherein the pin structure comprises:

a base; and eight pins comprising a first pin, a second pin, a third pin, a fourth pin, a fifth pin, a sixth pin, a seventh pin and an eighth pin, wherein one end of each pin has a contact part, the contact parts are aligned in sequence, the other end of each pin is bent to form an inserting part, and the inserting parts are embedded in the base;

wherein, a distance between the inserting parts of the third pin and the sixth pin is smaller than a distance between the contact parts of the third pin and the sixth pin, wherein the inserting parts of the first pin, the second pin, the fourth pin, the fifth pin, the seventh pin and the eighth pin are located at a second height, the inserting parts of the third pin and the sixth pin are located at a first height, and the first height is different from the second height.

16. The RJ connector module of claim 15, wherein there are no other pins been disposed between the inserting parts of the third pin and the sixth pin.

17. An RJ connector system, comprising:

an RJ connector module comprising:

a filter, and at least a pin structure electrically connected with the filter, wherein the pin structure comprises:

a base, and eight pins comprising a first pin, a second pin, a third pin, a fourth pin, a fifth pin, a sixth pin, a seventh pin and an eighth pin, wherein one end of each pin has a contact part, the contact parts are aligned in sequence, the other end of each pin is bent to form an inserting part, the inserting parts are embedded in the base, and a distance between the inserting parts of the third pin and the sixth pin is smaller than a distance between the contact parts of the third pin and the sixth pin, wherein the inserting parts of the first pin, the second pin, the fourth pin, the fifth pin, the seventh pin and the eighth pin are located at a second height, the inserting parts of the third pin and the sixth pin are located at a first height and the first height is different from the second height; and a main circuit board electrically connected with the pins.

18. The RJ connector system of claim 17, wherein there are no other pins been disposed between the inserting parts of the third pin and the sixth pin.

* * * * *